US005931394A

United States Patent [19]

Haven et al.

[11] Patent Number: 5,931,394

[45] Date of Patent: Aug. 3, 1999

[54] ANTI-SPIN MECHANISM FOR GYRATORY CRUSHER

[75] Inventors: Matthew B. Haven, Cedarburg; James C. Bremer, Slinger, both of Wis.

[73] Assignee: Astec Industries, Inc., Chattanooga, Tenn.

[21] Appl. No.: 09/050,493

[22] Filed: Mar. 30, 1998

[51] Int. Cl.[6] ..... B02C 2/04

[52] U.S. Cl. ..... 241/30; 241/215

[58] Field of Search ..... 241/207–216, 241/30

[56] References Cited

U.S. PATENT DOCUMENTS

| | | |
|---|---|---|
| 1,523,674 | 1/1925 | Torrance . |
| 1,641,776 | 9/1927 | Newhouse . |
| 3,207,449 | 9/1965 | Johnson . |
| 3,743,193 | 7/1973 | DeDiemar et al. . |
| 3,750,809 | 8/1973 | DeDiemar et al. . |
| 4,037,800 | 7/1977 | Coxhill . |
| 4,168,036 | 9/1979 | Werginz . |
| 4,206,881 | 6/1980 | Werginz . |
| 4,232,833 | 11/1980 | Werginz . |
| 4,467,971 | 8/1984 | Schuman . |
| 4,666,092 | 5/1987 | Bremer . |
| 4,697,745 | 10/1987 | Sawant et al. . |
| 4,750,681 | 6/1988 | Sawant et al. . |
| 4,779,808 | 10/1988 | Graf . |
| 5,653,393 | 8/1997 | Tanaka et al. . |

FOREIGN PATENT DOCUMENTS

| | | |
|---|---|---|
| 731 224 | 2/1943 | Germany . |
| 1069854 | 1/1984 | Russian Federation . |

*Primary Examiner*—Mark Rosenbaum
*Attorney, Agent, or Firm*—Willes & Willes, S.C.

[57] ABSTRACT

A gyratory crusher includes an anti-spin mechanism which is coupled to a lower end of a main shaft of the crusher and which prevents the main shaft and associated crushing head from spinning when the crusher is not subject to a crushing load. The anti-spin mechanism includes 1) a hydraulic brake, and 2) a gear train which couples the main shaft to the hydraulic brake so as to drive the hydraulic brake to rotate faster than the main shaft while at the same time permitting relative sliding motion between the main shaft and the hydraulic brake without unduly increasing the complexity or height of the crusher. The hydraulic brake is supercharged so as to respond immediately to a tendency of the main shaft to spin. As a result, only relatively low braking forces are required to prevent spinning.

33 Claims, 6 Drawing Sheets

ANTI-SPIN MECHANISM FOR GYRATORY CRUSHER

BACKGROUND OF THE INVENTION

1. Field of the Invention

The invention relates to gyratory crushers and, more particularly, to gyratory crushers of the type having a crushing head mounted on an eccentric main shaft and incorporating a mechanism to prevent the main shaft and crushing head from spinning in the absence of a crushing load.

2. Discussion of the Related Art

Gyratory or cone crushers (sometimes known as gyrasphere crushers) are well known for crushing stone. A typical gyratory crusher includes 1) a stationary frame, 2) a generally conical crushing head mounted for rotation about an eccentric main shaft and including an upwardly facing convex crushing surface, and 3) an annular crusher bowl or concave that is mounted in the frame above the crushing head so as to define a crushing gap forming an annular crushing chamber. Eccentric rotation of the main shaft is effected by rotatably mounting the shaft on the crusher's main drive gear or bull gear on an axis which is offset from and inclined with respect to the axis of rotation of the main drive gear.

During a crushing operation, the crushing head, through the material being crushed, is placed in rolling engagement with the concave or crusher bowl and thus rotates, relative to the stationary frame and the main drive gear, in a direction opposite to the direction of main drive gear rotation. The crushing head and main shaft are mounted so as to be freely rotatable within the main drive gear to accommodate such relative rotation. However, in the absence of a crushing load, the crushing head tends to "spin" or rotate in the same direction and at the same speed as the main drive gear. When material to be crushed is fed into the crushing cavity and contacts the freely spinning crushing head, the material detrimentally abrades the crushing head and also the concave, both of which are typically formed from a relatively soft manganese liner. Initial contact between the stone or other materials to be crushed and the freely spinning head also can result in ejection of small and even some relatively large stones from the crusher, risking damage to external components of the crusher or injury to personnel in the vicinity of the crusher.

Many so-called "anti-spin" mechanisms have been proposed to eliminate or at least inhibit free spinning of an unloaded crushing head. Examples of such anti-spin mechanism are disclosed in U.S. Pat. No. 3,207,449 to Johnson; 3,743,193 to DeDiemar et al.; U.S. Pat. No. 3,750,809 to DeDiemar et al.; U.S. Pat. No. 4,206,881 to Werginz; U.S. Pat. No. 4,467,971 to Schuman; and U.S. Pat. No. 4,666,092 to Bremer. All of these patents disclose anti-spin mechanisms employing hydraulic brakes or some other device located near the upper end of the main shaft, i.e., within the crushing head, to resist or prevent crushing head spinning. The anti-spin mechanisms disclosed in all of these patents therefore are incompatible or at least ill-suited for use with a solid main shaft or one lacking a large internal axial bore.

Apart from problems of complexity and incompatibility with many eccentric shafts, another problem associated with many of the anti-spin mechanisms disclosed by the patents listed above is that the length of the main shaft and associated drive elements must be increased substantially to accommodate the anti-spin mechanism, leading to a significant increase in the overall axial height of the crusher. This represents a problem because crushers form but one component of a quarry system and must be sized to be compatible with augers, elevators, and conveyors commonly employed in quarry systems.

Still another problem associated with the anti-spin mechanisms disclosed in many of the patents listed above is that they are not very robust and cannot survive the severe vibrations and shock loads imposed on the mechanisms during crushing for prolonged periods of time. Moreover, many of these mechanisms are relatively inaccessible and difficult to install initially and to replace when they fail.

Yet another problem associated with many heretofore available anti-spin mechanisms is that they can never permit rotation of the main shaft and crushing head in the same direction that the main drive or bull gear rotates. Accordingly, if the crushing head becomes jammed due, e.g, to the introduction of non-crushable materials (known as tramp) into the crusher, the anti-spin mechanism and/or other components of the crusher are destroyed.

Some of these problems can be understood by a more detailed review of specific prior art references.

For instance, an overrunning clutch-based anti-spin mechanism is disclosed in the Johnson patent. The overrunning clutch is connected to the main shaft by a sliding coupling that permits relative sliding movement between the main shaft and the overrunning clutch but that prohibits relative rotational movement therebetween. The overrunning clutch includes 1) an input shaft coupled to the head and 2) a one-way clutch element that is coupled to the input shaft and that permits main shaft rotation in the crushing direction while prohibiting main shaft rotation in the spinning direction.

The anti-spin mechanism disclosed in the Johnson patent exhibits notable drawbacks. For instance, the sliding coupling is located within the upper portion of the crushing head and hence is incompatible for use with a solid main shaft or one lacking a large internal axial bore. Moreover, the one-way clutch element is incapable of permitting main shaft rotation in the spinning direction. A separate brake or shear pin therefore must be provided to permit shaft rotation in the spinning direction in the event that tramp becomes lodged in the crushing gap.

An exemplary hydraulic brake is disclosed in the Werginz '881 patent. The Werginz '881 patent discloses a main shaft that is rotationally coupled to a bidirectional hydraulic motor. The hydraulic motor is disposed in a hydraulic circuit including 1) an unpressurized reservoir (typically filled with lubricating oil also used to lubricate the main shaft and other components of the crusher), 2) a check valve, and 3) a relief valve. Rotation of the main shaft in the crushing direction causes oil to circulate from the reservoir upwardly through the check valve and back to the reservoir without imparting any substantial resistance to hydraulic motor rotation. However, hydraulic motor rotation in the opposite direction is resisted by the check valve which prevents fluid flow through the circuit in that direction. Limited fluid flow around the check valve is possible only when the fluid pressure generated by the rotating motor exceeds a value at which the relief valve opens, thereby permitting limited motor rotation and preventing damage to the hydraulic brake in the event that the crushing head becomes jammed by tramp.

While the hydraulic brake disclosed in the Werginz '881 patent is generally effective, it is relatively slow to react to main shaft spinning due to the fact that the hydraulic fluid is not pressurized before it is drawn into the hydraulic motor.

Motor leakage and other factors therefore permit an air cushion to form at the inlet side of the hydraulic motor. This air cushion delays the response of the hydraulic motor to main shaft spinning because the hydraulic motor can rotate in the spinning direction until the air cushion is eliminated. By this time, the main shaft has built up substantial inertia and hence requires higher braking forces then would be required if shaft rotation in the spinning direction is prevented altogether. The hydraulic motor therefore must be oversized. In addition, the risk of damage to crusher components is increased because substantial shock loads are imposed on those components during rapid deceleration of the rotating main shaft. At least some of these problems are exacerbated by the fact that the hydraulic motor is rotating at the same low velocity as the main shaft (typically about 10–20 RPM) and cannot always generate adequate pressure for effective braking.

OBJECTS AND SUMMARY OF THE INVENTION

It is therefore a primary object of the invention to provide a gyratory crusher having an anti-spin mechanism which reacts immediately to a tendency of the crusher's main shaft to spin so that spinning is actually prevented as opposed to braked after it begins.

In accordance with a first aspect of the invention, this object is achieved by providing a gyratory crusher comprising, a stationary frame, a main drive gear which is mounted on the frame and which is driven to rotate about a vertical axis, a main shaft, a crushing head mounted on the main shaft, and an anti-spin mechanism. The main shaft 1) is rotatably supported on the main drive gear at a location which is offset from the vertical axis so as to rotate eccentrically with respect to the vertical axis, and 2) rotates in a crushing direction during a crushing operation. The anti-spin mechanism comprises a hydraulic brake which includes a source of pressurized hydraulic fluid and a hydraulic motor. The hydraulic motor is rotationally coupled to the main shaft and imparts a substantial resistance to main shaft rotation in a spinning direction which is opposite to the crushing direction. The hydraulic motor is supercharged by the source of pressurized hydraulic fluid so as to react essentially immediately to a tendency of the main shaft to rotate in the spinning direction.

Preferably, the anti-spin mechanism further comprises a gear train operatively coupled to a lower portion of the main shaft and to the hydraulic brake. The gear train preferably comprises 1) a sliding coupling to which the main shaft is slidably coupled and which rotates with the main shaft, and 2) a gear reducer which rotationally couples the sliding coupling to the hydraulic motor so that the hydraulic motor is driven by the sliding coupling to rotate at a higher speed than the main shaft.

The crusher preferably also comprises a hydraulic circuit in which is disposed the hydraulic motor and the source of pressurized hydraulic fluid. The hydraulic circuit imposes minimal damping to rotation of the hydraulic motor when the main shaft rotates in the crushing direction but imposes a substantial damping to rotation of the hydraulic motor when the main shaft tends to rotate in the spinning direction. Preferably, the hydraulic circuit further comprises 1) a conduit into which hydraulic fluid is forced from the hydraulic motor when the main shaft rotates in the spinning direction, and 2) a check valve which is disposed in the conduit and which prevents fluid flow therethrough from the hydraulic motor.

Another object of the invention is to provide an anti-spin mechanism that meets the first principal object and that still permits rotation of the main shaft in its spinning direction under limited circumstances to prevent damage to system components due to crushing head jamming or due to overly rapid deceleration of the crushing head.

In accordance with another object of the invention, this object is achieved by providing a relief valve which is disposed in parallel with the check valve and which permits limited fluid flow around the check valve from the hydraulic motor. The relief valve preferably is adjustable to permit a threshold pressure to be set below which fluid will not flow through the relief valve.

Another object of the invention is to provide an anti-spin mechanism which meets the first principal object and which requires minimal modifications to crusher design for its implementation.

Another object of the invention is to provide an anti-spin mechanism which has the characteristics discussed above and which is relatively robust.

Still another object of the invention is to provide an anti-spin mechanism which exhibits one or more of the characteristics discussed above and which is relatively easy to install and replace.

In accordance with yet another aspect of the invention, these objects are achieved by coupling an anti-spin mechanism, preferably one employing a hydraulic brake, to the lower end of the main shaft.

A second principal object of the invention is to provide an improved method of preventing a main shaft of a gyratory crusher from spinning.

In accordance with still another aspect of the invention, this object is achieved by 1) providing a method comprising providing a gyratory crusher including a stationary frame, a main drive gear rotatably mounted on the frame, and a main shaft which is mounted on the main drive gear so as to be rotatable about an axis which is offset from a central axis of the drive gear, driving the main drive gear to rotate, 2) permitting the main shaft to rotate about its axis in a crushing direction during a crushing operation in which rock is being crushed by the crusher, and 3) selectively braking the main shaft. The braking step includes imparting a substantial resistance to main shaft rotation in a spinning direction which is opposite to the crushing direction. The resistance is imposed by a hydraulic motor which is supercharged by a source of pressurized hydraulic fluid so as to react essentially immediately to a tendency of the main shaft to rotate in the spinning direction.

Preferably, in order to further increase reaction speed, the hydraulic motor is coupled to the main shaft by a gear train which couples the hydraulic motor to the main shaft so that the hydraulic motor rotates at a higher speed than the main shaft. The hydraulic motor preferably rotates at about fifty times the rotational speed of the main shaft.

Preferably, the braking step comprises 1) forcing hydraulic fluid into a conduit from the hydraulic motor when the main shaft rotates in the spinning direction, and 2) preventing fluid flow through the conduit via operation of a check valve which is disposed in the conduit. Limited hydraulic fluid flow preferably is permitted around the check valve when hydraulic pressure in the conduit exceeds a threshold value.

Other objects, features, and advantages of the present invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENT

1. Resume

Pursuant to the invention, a gyratory crusher is provided with an anti-spin mechanism which is coupled to a lower end of a main shaft of the crusher and which prevents the main shaft and associated crushing head from spinning when the crusher is not subject to a crushing load. The anti-spin mechanism includes 1) a hydraulic brake, and 2) a gear train preferably couples the main shaft to the hydraulic brake so as to drive the hydraulic brake to rotate faster than the main shaft while at the same time permitting relative sliding motion between the main shaft and the hydraulic brake without unduly increasing the complexity or height of the crusher. The hydraulic brake is supercharged (i.e., supplied with pressurized hydraulic fluid from a separate source) so as to respond immediately to a tendency of the main shaft to spin. As a result, only relatively low braking forces are required to prevent spinning.

2. System Overview and Construction of Anti-Spin Mechanism

Figure 1:
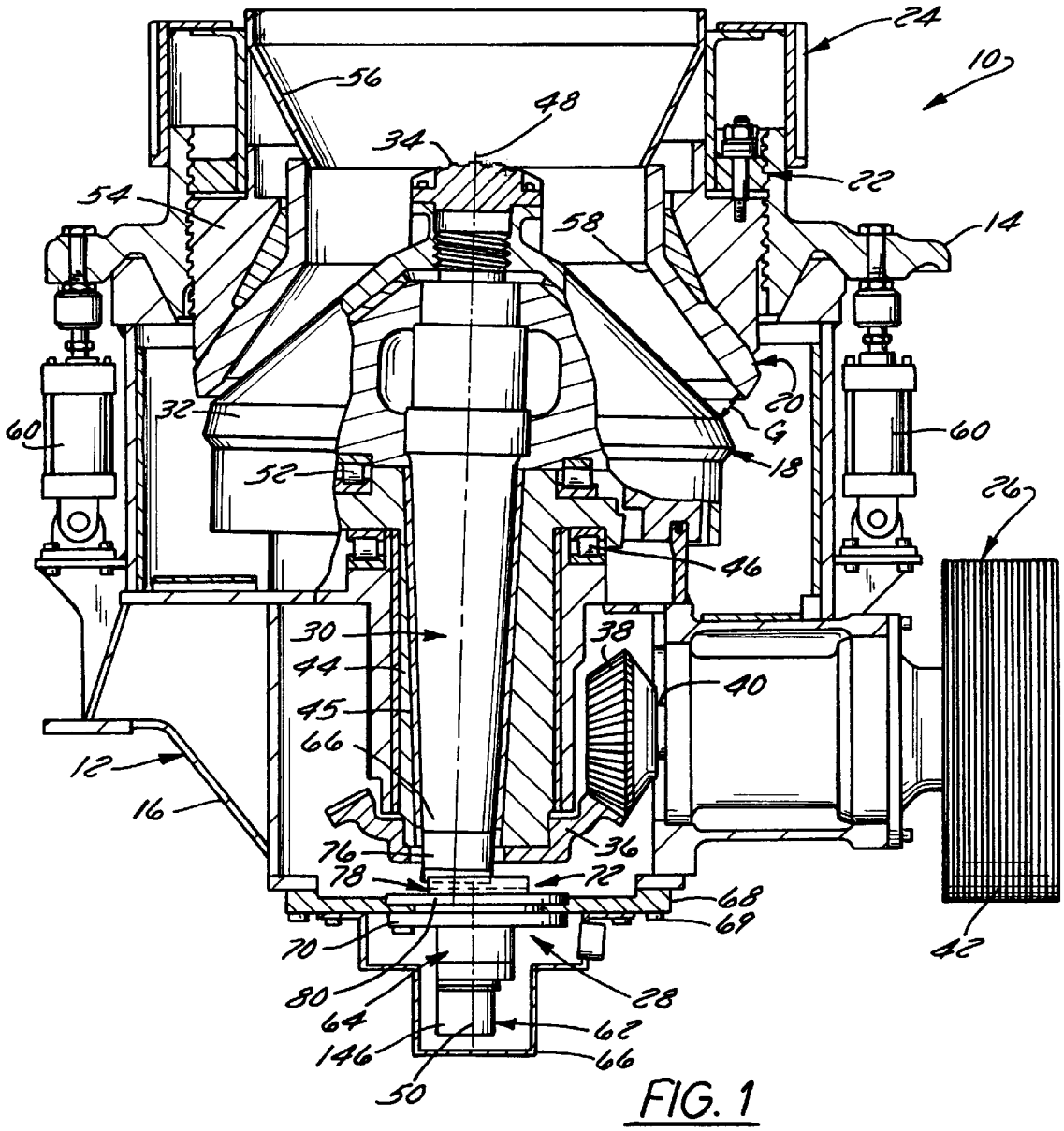
FIG. 1 is a sectional side elevation view of a gyratory crusher constructed in accordance with a preferred embodiment of the invention.
Figure 8:
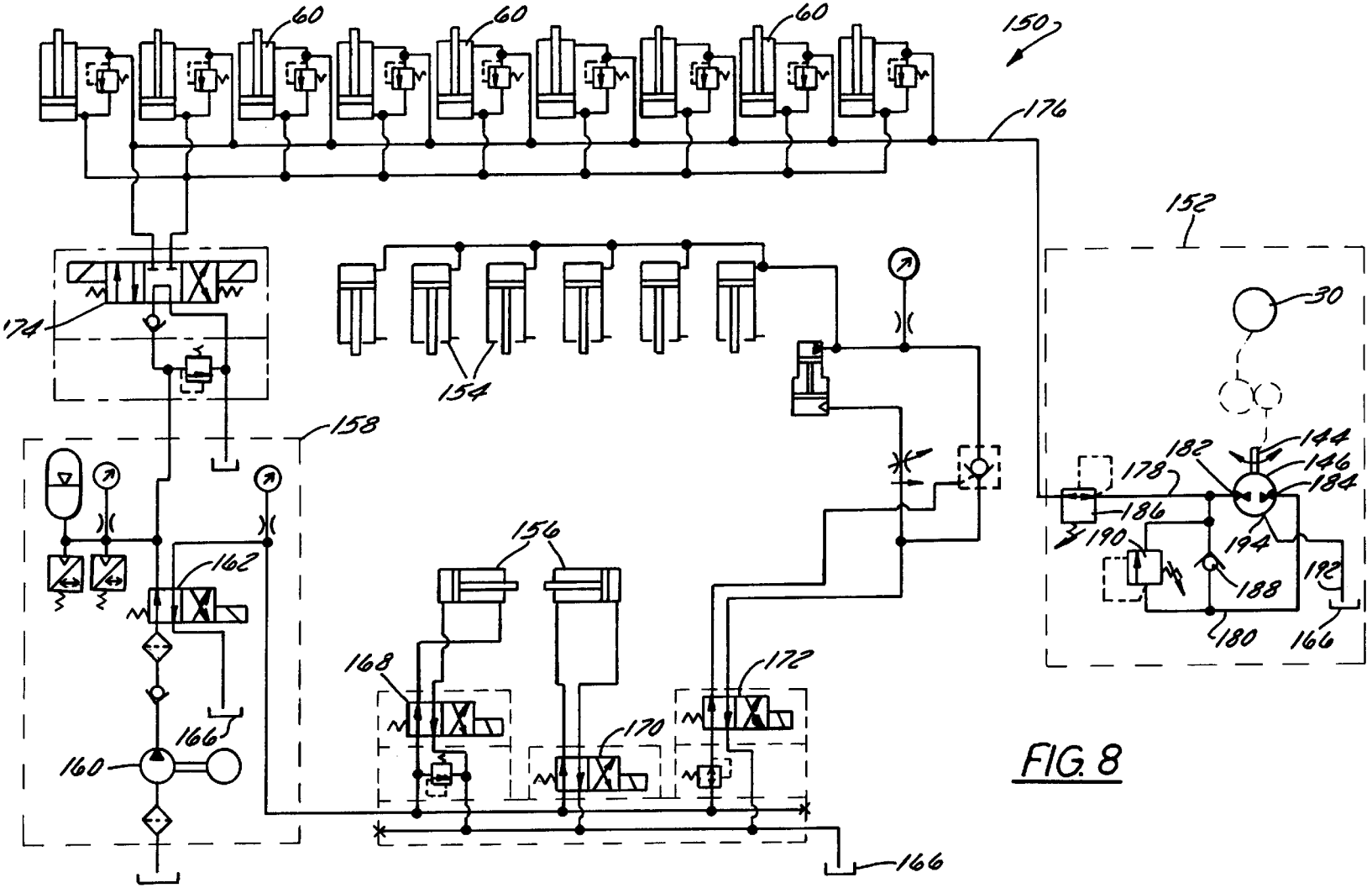
FIG. 8 is a schematic hydraulic circuit of the crusher of FIG. 1.

Referring now to the drawings and to FIG. 1 in particular, a gyratory or cone crusher 10 (sometimes known as a gyrasphere crusher) is illustrated. Crusher 10 includes a main crusher frame 12 having upper and lower portions 14 and 16, a crushing head 18 mounted on the crusher frame lower portion 16, and a crusher bowl 20 mounted on the crusher frame upper portion 14 above the crushing head 18. The crusher bowl 20 is normally held fast from rotation with respect to the crusher frame upper portion 14 by a bowl lock assembly 22, but the bowl lock assembly 22 is selectively releasable using cylinders 154 (FIG. 8) to permit vertical adjustment of the bowl 20 relative to the head 18 using a bowl adjuster mechanism 24 actuated by adjusting cylinders 156 (FIG. 8). Rotation of the crushing head 18 is controlled by a drive mechanism 26 and by an anti-spin mechanism 28 detailed in Section 3. below.

The crushing head 18 is fixedly mounted on the upper end 34 of a main shaft 30 and is generally frusto-conical in shape. The outer, crushing portion or mantle of the crushing head 18 is formed from a replaceable manganese liner 32 threaded onto the upper end 34 of the main shaft 30 as illustrated in FIG. 1. The main shaft 30 is mounted on a main drive or bull gear 36 comprising a bevel gear driven by the drive mechanism 26. The drive mechanism 26 comprises 1) a spur gear 38 meshing with the main drive gear 36, 2) a horizontal input shaft or countershaft 40 journaled in the crusher frame lower portion 16 and connected at its inner end to the gear 38, and 3) a sheave 42 mounted on the outer end of the countershaft 40 and driven in a conventional manner.

A generally tubular support member 44 is fixed to the main drive gear 36 and extends upwardly therefrom so as to be rotatably journaled in the crusher frame lower portion 16 by bearings 46. The main shaft 30 extends through the tubular support member 44 on an axis 48 which is offset from and inclined with respect to the axis of rotation 50 of the main drive gear 36 and is supported in the tubular support member 44 by a bearing sleeve 45. The crushing head 18 and thus the shaft 30 are rotatably supported on the tubular support member 44 by upper bearings 52. The main shaft 30 is of a type which is either solid or has only relatively small lubrication bores formed axially therethrough for the purpose of permitting and limiting flow of lubricating fluid to the bearings 46, 52. It is important to note that this and similar eccentric shafts cannot support hydraulic brakes or other anti-spin mechanisms at their upper ends.

The crusher bowl 20 includes a body or frame 54, an upper uncrushed and/or pre-crushed rock feed hopper 56, and a lower concave surface 58 (often referred to as "a concave") which is formed from a replaceable manganese liner. Concave surface 58 surrounds the manganese liner 32 forming the convex crushing surface of the crushing head 18 and is spaced above it to define a crushing gap G having a thickness which varies around the circumference of the crushing head 18 due to the eccentric mounting of the eccentric shaft 30 and the crushing head 18 on the main drive gear 36. In order to permit vertical adjustment of the crusher bowl 20 relative to the crusher frame 12 and thus to permit adjustment of the thickness of the gap G, a helically threaded connection is provided between the crusher bowl 20 and the frame upper portion 14 to permit vertical adjustment of the bowl 20 relative to the frame upper portion 14. The bowl 20 is normally locked from rotation with respect to the frame upper portion 14 by the bowl lock assembly 22, but the bowl lock assembly 22 can be selectively released to permit rotation of the crusher bowl 20 relative to the frame 12 for gap adjustment purposes, under the action of the adjuster mechanism 24, in a manner which is, per se, well known. The crusher frame upper portion 14 is connected to the crusher frame lower portion 16 by a plurality of tramp relief cylinders 60 which can be selectively actuated to lift the crusher frame upper portion 14 for tramp relief purposes in a conventional manner.

3. Construction of Anti-Spin Mechanism

The gyratory or cone crusher 10 as thus far described (save for the brief description of the anti-spin mechanism 28) would operate acceptably except for the fact that the crushing head 18 and main shaft 30 would spin in the absence of a crushing load due to the fact that the main shaft 30 is rotatably journaled in the main drive gear or bull gear 36 and due to the fact that the main drive gear 36 rotates at a relatively high rate, typically about 300–400 rpm. Crushing head spinning is undesirable because, upon initiation of a crushing action, contact between the stone and the rapidly spinning crushing head 18 would rapidly abrade and prematurely wear the manganese liner 32. Moreover, contact between the stones and the rapidly spinning crushing head 18 could cause at least some of the stones to be thrown out of the crusher 10 and risk damage to the crusher 10 or possible injury to personnel in the surrounding area. Crushing head spinning also would tend to channel rocks towards the widest point of the crushing gap G and cause many smaller stones to fall through the crushing chamber without being crushed. It is for these reasons that an anti-spin mechanism is desirable and that the inventive anti-spin mechanism 28 is provided.

The anti-spin mechanism 28 is designed to prevent undesired crushing head spinning in the absence of a crushing load by reacting immediately to a tendency of the main shaft 30 to spin rather than by braking a spinning main shaft. Inertial loads on the main shaft 30 therefore are reduced. The anti-spin mechanism 28 also is designed to permit main shaft rotation in the spinning direction in the event that the crushing head 18 becomes jammed by tramp or in the event that rapid main shaft deceleration would place undue shock loads on the main shaft 30 and the anti-spin mechanism 28.

Figure 2:
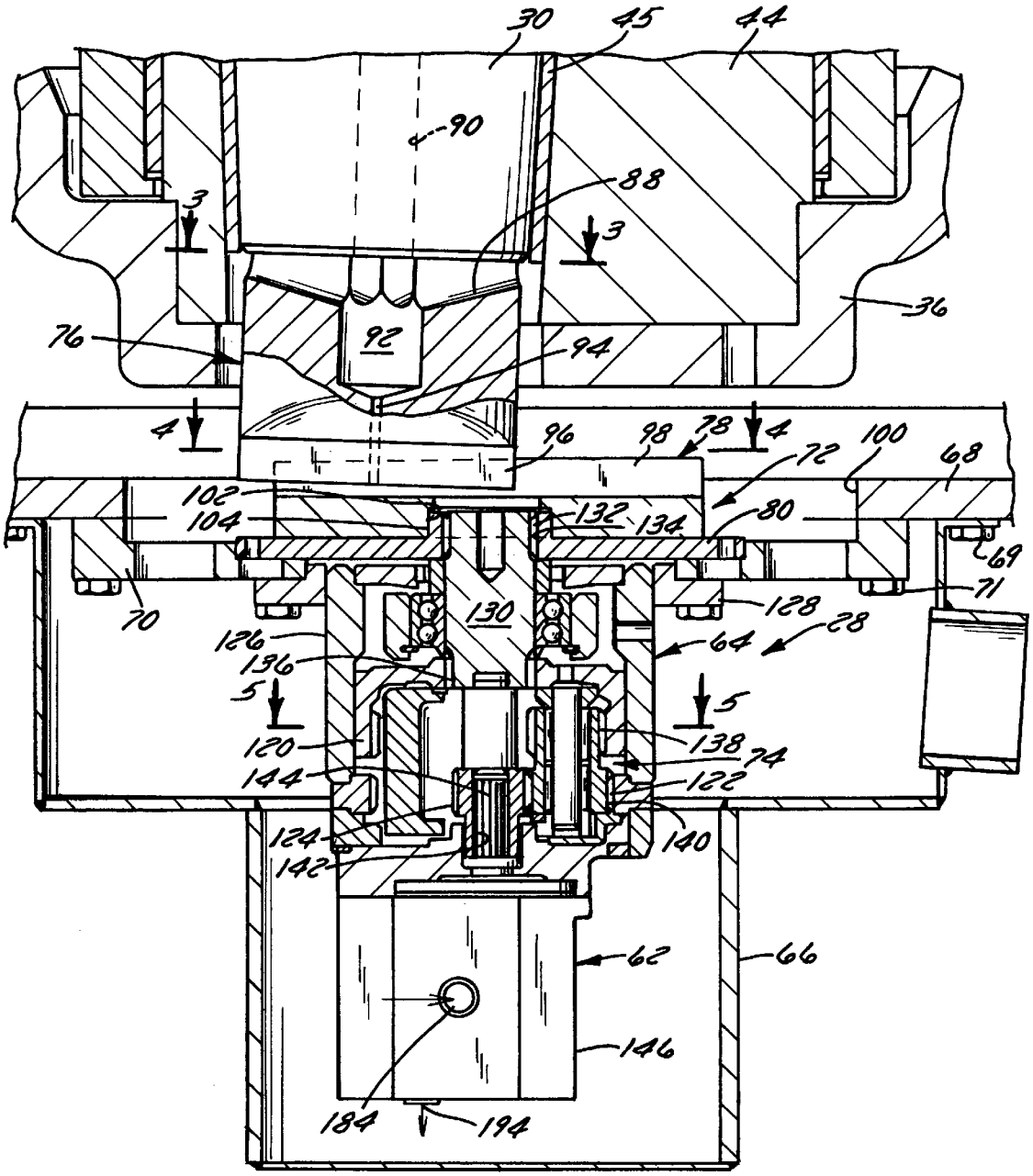
FIG. 2 is an enlarged sectional elevation view of a portion of the crusher of FIG. 1 and illustrating an anti-spin mechanism of the crusher in greater detail.
Figure 3:
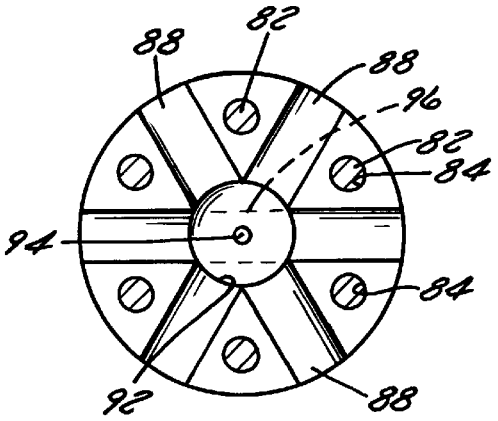
FIG. 3 is a sectional end view taken generally along the lines 3—3 in FIG. 2.
Figure 7:
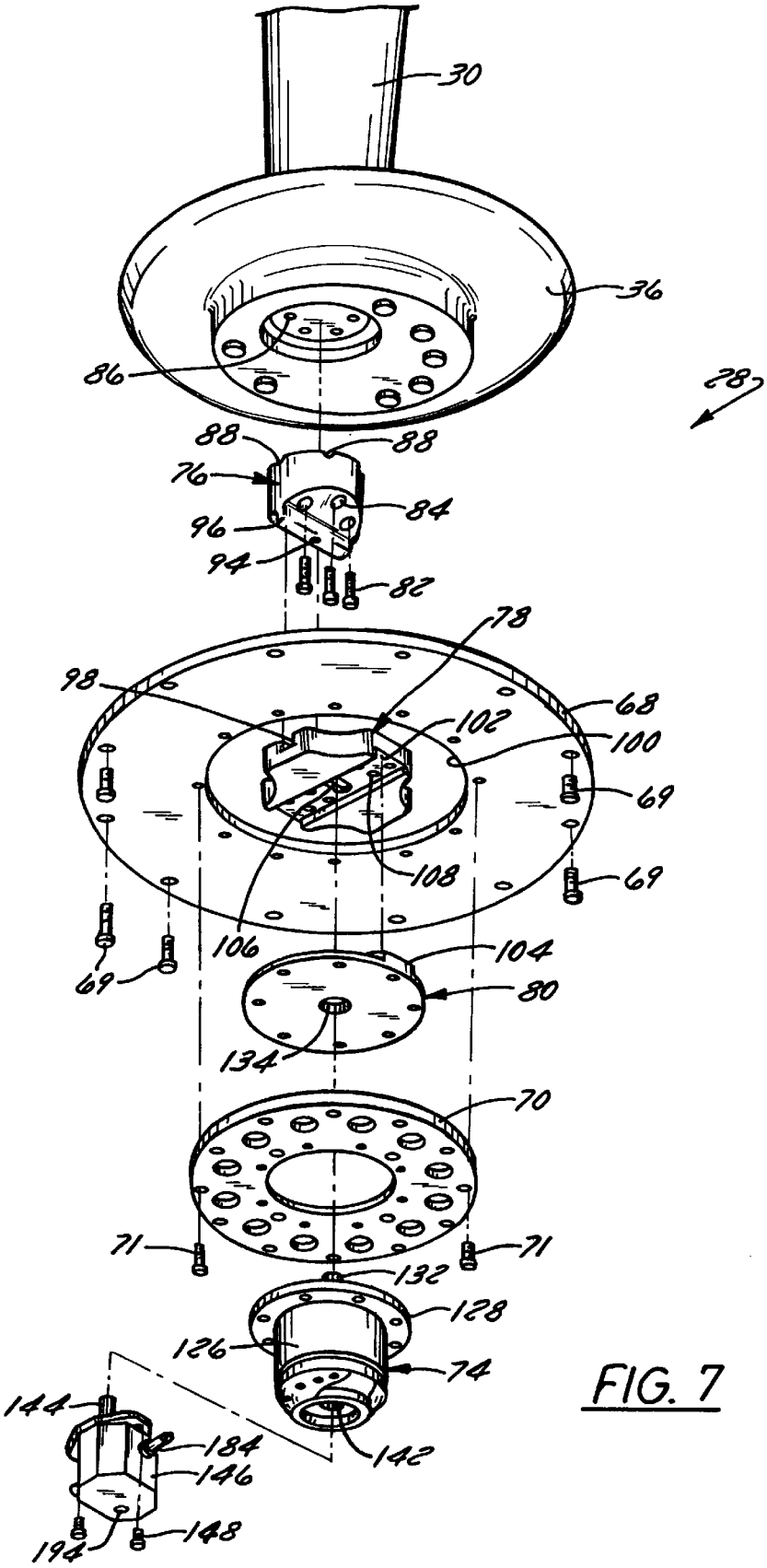
FIG. 7 is an exploded perspective view of a portion of the gear train.

Towards these ends, and referring particularly to FIGS. 2 and 7, the anti-spin mechanism 28 includes as its principal components 1) a supercharged hydraulic brake 62 and 2) a gear train 64 coupling the hydraulic brake 62 to the main shaft 30. The anti-spin mechanism 28 is encased in fluid-tight housing 66 supported by the bottom surface of the crusher frame lower portion 16 via an adapter plate 68 described below. The gear train 64 and hydraulic brake 62 will be described in turn.

The gear train 64 performs several functions. First, it rotationally couples a hydraulic motor 146 of the hydraulic brake 62 to the main shaft 30 while accommodating eccentric movement of the main shaft 30 relative to the hydraulic motor 146. Second, it effects a torque reduction and speed increase so that the hydraulic motor 146 rotates at a higher speed than the main shaft 30. This speed increase is beneficial because the main shaft 30 typically rotates at a relatively slow speed, usually about 5% of the speed of the main drive gear 36 or about 17 rpm and because most hydraulic motors do not pump efficiently at such low speeds.

Figure 6:
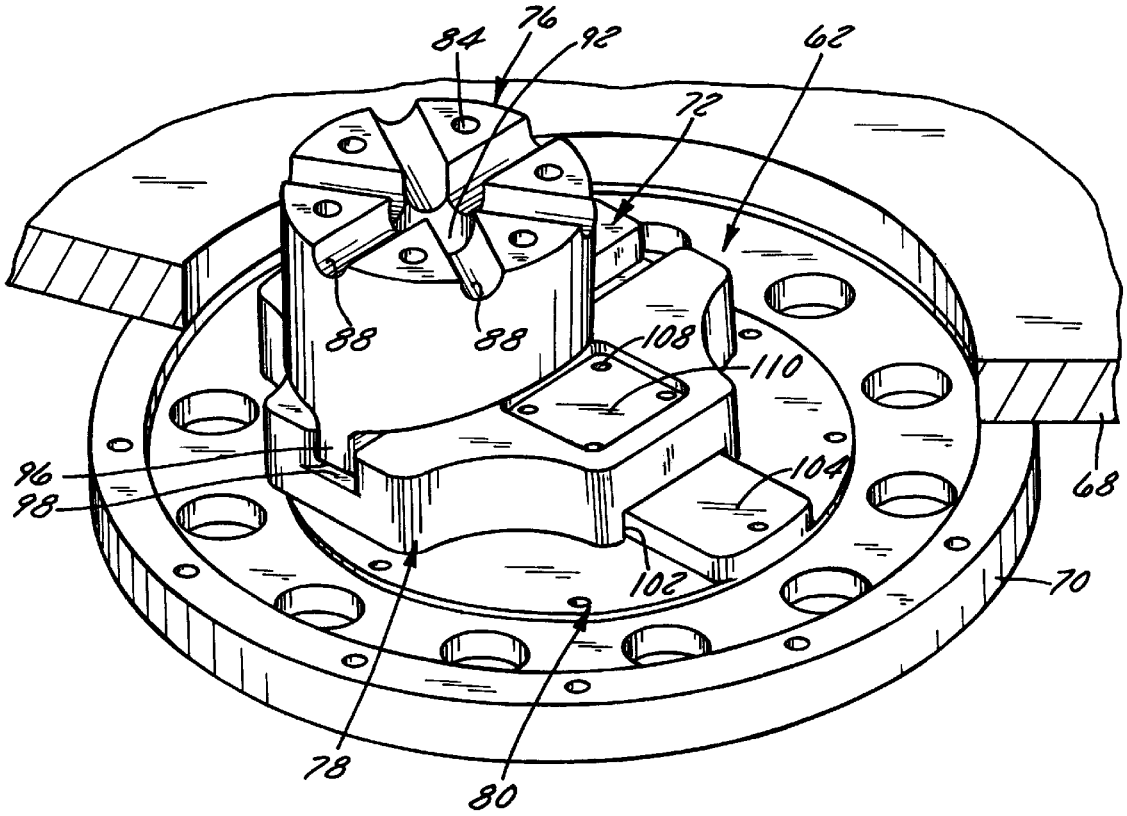
FIG. 6 is a fragmentary perspective view of a portion of a gear train of the anti-spin mechanism.

The gear train 64 is supported on the crusher mainframe lower portion 16 by a support assembly including an adapter plate 68 and a driven gear retainer bearing 70. As best seen in FIGS. 2, 6, and 7, the adapter plate 68 is attached directly to the crusher frame lower portion 16 by a plurality of bolts 69 spaced around the periphery of the adapter plate 68. The driven gear retainer bearing 70 1) is attached to the bottom surface of the adapter plate 68 by bolts 71 and 2) supports the gear train 64 as detailed below.

The gear train 64 includes as its major components a sliding coupling 72 and a gear reducer 74. Each of these components now will be discussed in turn.

The purpose of the sliding coupling 72 is to prevent relative rotation between the hydraulic motor 146 and the main shaft 30 while permitting relative sliding movement therebetween to accommodate eccentric rotation of the main shaft 30 relative to the hydraulic motor 146. Referring particularly to FIGS. 2–4 and 7, the sliding coupling 72 includes as its principal components a tang 76, a follower gear 78, and a driven gear 80.

The tang 76 is fixed to the bottom end of the main shaft 30 at its upper end and mates with the follower gear 78 at its lower end so as to prevent relative rotation between the tang 76 and the follower gear 78 while permitting sliding movement therebetween in an "X" direction. The tang 76 is attached to the bottom end of the main shaft 30 by a plurality of bolts 82 that extend through through-bores 84 in the tang 76 and that are threaded into tapped bores 86 in the lower end of the main shaft 30 as best seen in FIG. 7. Cross channels 88 are formed in the upper surface of the tang 76 so as to direct lubricating oil from axial bores 90 in the main shaft 30 to a radially-central, axially-extending receptacle 92 in the tang 76 that is best seen in FIG. 2 and that acts as a funnel for channeling lubricating oil to a lubricating bore 94. The lubricating oil is the same oil used to lubricate relative motion between the main shaft 30 and the surrounding tubular support 44 and outer sleeve 45. A downwardly-extending tongue 96 is formed in the bottom surface of the tang 76 and mates with a complimentary groove 98 formed in the upper surface of the follower gear 78. It is this tongue-and-groove connection that fixes the follower gear 78 from rotation with respect to the tang 76 while permitting relative sliding motion therebetween. This sliding motion is facilitated by lubricating oil supplied to the groove 98 by the lubricating bore 94, which extends downwardly from the receptacle 92 to the bottom of the tongue 96 as best seen in FIG. 2.

Figure 4:
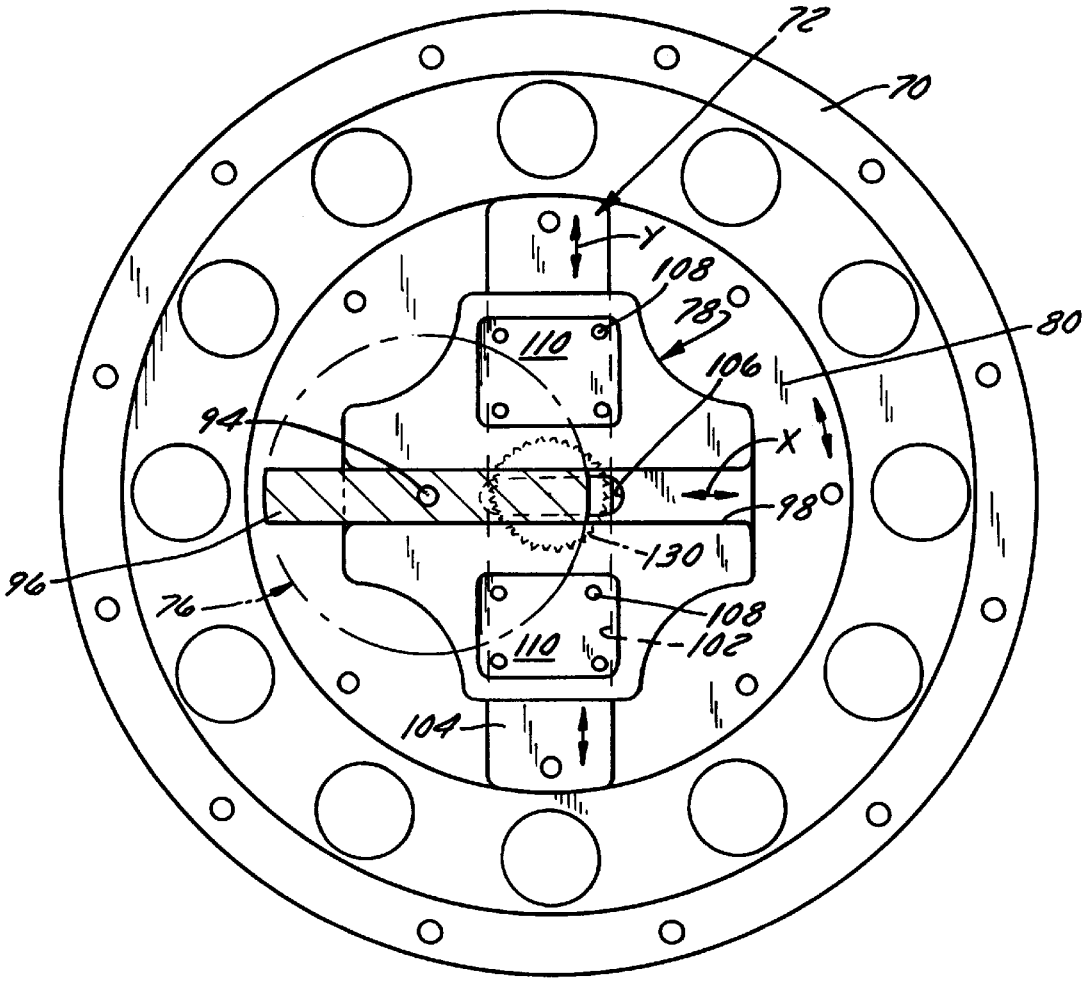
FIG. 4 is a sectional end view taken generally along the lines 4—4 in FIG. 2.

As best seen in FIGS. 4, 6, and 7, the follower gear 78 and driven gear 80 are received in a central aperture 100 of the adapter plate 68 such that the follower gear 78 rests upon and rotates with the driven gear 80. The driven gear 80 in turn rests on the driven gear retainer bearing 70 as best seen in FIG. 2 so as to slidably rotatable with respect thereto. A tongue 104 is formed on the upper surface of the driven gear 80 for mating with a bottom groove 102 on the follower gear 78 so as to permit sliding movement of the follower gear 78 relative to the driven gear 80 in a "Y" direction which is perpendicular to the "X" direction while preventing relative rotational movement therebetween.

Sliding movement between the follower gear 78 and the driven gear 80 is facilitated by lubricating oil. The lubricating oil is supplied to the lower tongue-and-groove connection 102 and 104 via 1) an axial through-bore 106 formed in the follower gear 78 that receives oil from the lubricating bore 94 in the tang 76, and 2) additional axial bores 108 in the follower gear 78 that mate with reservoirs 110 that are formed on the upper surface of the follower gear 78 at opposite sides of the groove 102 and that receive lubricating oil directly from the main shaft 30.

The gear reducer 74 serves an important function. Specifically, it steps up the speed of the hydraulic motor 146 relative to the main shaft 30 so that the hydraulic motor 146 rotates at a sufficiently-high velocity to provide effective main shaft braking without having to over-size the hydraulic motor 146. At the same time, it reduces the torque supplied to the hydraulic motor 146 by the main shaft 30 to reduce motor wear and to inhibit early failure. The torque reduction and speed increase should be at least 5:1, and preferably at least 20:1 and most preferably are about 50:1. This speed increase and accompanying torque reduction could be achieved via a variety of mechanisms. However, a differential planetary gear set is preferred because 1) it is simple, 2) it is compact so as to not unduly increase the overall length of the crusher, and 3) it is robust. The gear reducer 74 therefore will hereafter be referred to as a "differential planetary gear set."

Figure 5:
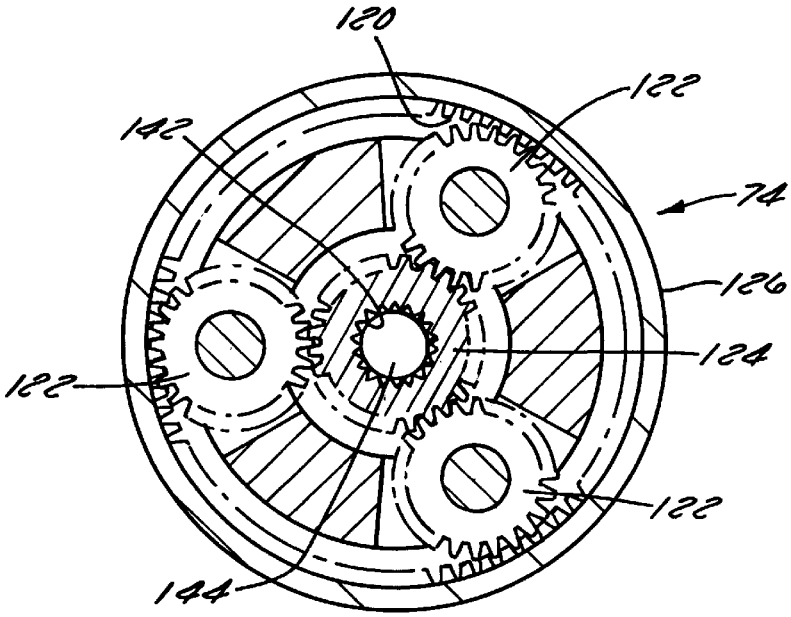
FIG. 5 is a sectional end view taken generally along the lines of 5—5 in FIG. 2.

As best seen in FIGS. 2 and 5, the differential planetary gear set 74 is coupled to the sliding coupling 72 by a torque shaft 130 having a splined upper end 132 mating with a splined bore 134 in the driven gear 80 and having a gear 136 on its lower end. The differential planetary gear 74 set includes a ring 120, a plurality of planet gears 122, and a sun gear 124, all contained in a housing 126. The housing 126 is attached to the bottom surface of the driven gear retainer bearing 70 via a plurality of bolts (not shown) extending through an annular flange 128 of the housing 126.

The ring 120 is press-fit or otherwise fixed to the interior periphery of the housing 126 and meshes with the planet gears 122. The planet gears 122 (three of which are provided in the illustrated embodiment) are spaced peripherally about the differential planetary gear set 74 with each planet gear 122 including upper and lower toothed portions 138 and 140 one of which meshes with the gear 136 on the torque shaft 130 and the other of which meshes with the sun gear 124. The sun gear 124 has a splined interior aperture 142 meshing with splines on an input shaft 144 for the hydraulic motor 146. Accordingly, torque is transmitted 1) from the driven gear 80 to the torque shaft 130, 2) from the torque shaft 130 to the upper toothed portion 138 of the planet gears 122, 3) from the lower toothed portion 140 of the planet gears 122 to the sun gear 124, and 4) from the sun gear 124 to the input shaft 144 for the hydraulic motor 146. The ring gear 120, planet gears 122, and sun gear 124 are dimensioned relative to one another to provide the desired torque reduction and speed increase. Hence, when all is said and done, the hydraulic motor 146 is driven to rotate at fifty times the speed of the main shaft 30 and in the same direction.

The hydraulic brake 62 may comprise any device capable of achieving the above-described unidirectional hydraulic braking but preferably includes a supercharged bidirectional hydraulic motor 146 which assuredly provides essentially instantaneous response to main shaft spinning. The hydraulic motor 146, best seen in FIGS. 2 and 7, is a conventional hydraulic motor 146 which is attached to the bottom surface of the differential planetary gear set housing 126 by bolts 148. Motors of this type usually are driven to rotate by another power source to generate hydraulic pressure for system components. However, when incorporated into a proper hydraulic circuit, the hydraulic motor 146 actually becomes a brake because the circuit resists motor rotation in the spinning direction. A hydraulic circuit suitable for this purpose could be self-contained but preferably forms a subcircuit of the crusher's main hydraulic circuit so as to be supercharged by the source of pressurized hydraulic fluid for the crusher's hydraulic circuit. A crusher hydraulic circuit 150 incorporating such a subcircuit 152 now will be described.

Referring now to FIG. 8, the crusher circuit 150 includes 1) the hydraulic brake subcircuit 152, 2) the tramp relief cylinders 60, 3) the concave unlock cylinders 154, and the concave adjusting cylinders 156, all supplied with pressurized hydraulic fluid via a source of pressurized hydraulic fluid 158. The source 158 preferably includes, inter alia, a high-pressure pump 160 and a control valve 162 of the type commonly found in gyratory crushers. The concave adjusting cylinders 156 and the concave unlock cylinders 154 are selectively supplied with pressurized hydraulic fluid from the source 158 and vented to a reservoir 166 via operation of solenoid-actuated valves 168, 170, and 172 in a manner which is, per se, known to those skilled in the art. As is also well known to those skilled in the art, the tramp relief cylinders 60 are controlled by a solenoid-actuated tramp relief valve 174 switchable between 1) the illustrated neutral position, 2) a "crush" position represented by the left portion of the valve 174, and 3) a "clear" position represented by the right portion of the valve 174. The valve 174 is placed in its "crush" position during normal operation so that the valve 174 supplies pressurized hydraulic fluid to a main supply line 176 from the source 158 at full system pressure of, e.g., 1,800–2,200 psi. This supply line 176 also serves as a supercharging input line for the hydraulic brake subcircuit 152 which will now be detailed.

The hydraulic brake subcircuit 152 includes 1) a reservoir 166 (which typically is the same reservoir used by other components of the crusher hydraulic circuit 150), 2) the hydraulic motor 146, and 3) first and second conduits 178 and 180 connected to first and second pump orifices 182 and 184 of the hydraulic motor 146. The first conduit 178 connects the first pump orifice 182 to the main supply line 176 via a pressure reducing valve 186 that reduces the pressure in the first conduit 178 from system pressure of, e.g., 1,800–2,200 psi to a much lower working pressure of about 50 psi. The second conduit 180 connects the first conduit 178 to the second pump orifice 184 of the hydraulic motor 146. A check valve 188 is disposed in the second conduit 180 to permit fluid to circulate through the subcircuit 152 when the hydraulic motor 146 rotates in one direction but to prevent reverse fluid flow therethrough when the hydraulic motor 146 rotates in the opposite direction. A pressure relief valve 190 is disposed in parallel with the check valve 188 for reasons that will become apparent below. A third conduit 192 is also provided to serve as a bleed conduit which drains fluid that leaks from a drain port 194 of the hydraulic motor 146 to the reservoir 166.

The hydraulic brake subcircuit 152 operates as follows:

Counterclockwise rotation of the main shaft 30 under a crushing load drives the hydraulic motor 146 to rotate counterclockwise as illustrated in FIG. 8. This counterclockwise rotation produces essentially uninhibited hydraulic fluid flow from the first pump orifice 182 of the hydraulic motor 146, through the check valve 188, and into the second pump orifice 184 in a continuous cycle so that motor rotation is not resisted or damped by hydraulic pressure. Conversely, if the main shaft 30 tends to spin, the hydraulic motor 146 will attempt to rotate clockwise as seen in FIG. 8. This attempt at clockwise rotation will force hydraulic fluid into the second conduit 180 from the second pump orifice 184, but fluid flow through the second conduit 180 is prevented by the check valve 188. As a result, pressure in the conduit 180 and the second pump orifice 184 increases rapidly to brake motor rotation. Compression of the oil during this operation provides a cushioning effect that reduces shock on system components when compared to shocks imposed by mechanical-based systems such as an overrunning clutch.

Immediate reaction to and braking of clockwise rotation of the hydraulic motor 146 is assured by the supercharging effect achieved by the supply of pressurized hydraulic fluid to the first pump orifice 182 from the main supply line 176 and the pressure reducing valve 186 which thereby assures that the hydraulic motor 146 is always fully charged. In the absence of this supercharging effect, an air cushion could build up within the hydraulic motor 146 so that substantial clockwise motor rotation would occur before the air cushion is eliminated and the hydraulic motor 146 generates sufficient fluid pressure at the second pump orifice 184 to resist additional motor rotation. During this time, substantial rotational inertias would accumulate so that substantially higher braking forces would be required to arrest movement of the rotating main shaft 130 than would be required to prevent rotation of a stationary main shaft. A substantially smaller and less expensive hydraulic motor 146 therefore can be utilized than would otherwise be required. Moreover, shocks to the main shaft 30, gear train 64, and hydraulic motor 146 that would otherwise result from braking the rotating shaft 30 are eliminated with resultant reduction in component wear and extension of component life. Supercharging is also important for replenishing oil loss to the hydraulic motor 146 due to internal leakage, which is a normal characteristic of components of hydraulic systems of this type.

However, the brake subcircuit 152 sometimes must permit the hydraulic motor 146 to rotate in the direction of main shaft spinning, either because the supercharging effect is imperfect or because an externally-applied force beyond inertial forces physically drives the main shaft 30 to rotate in the spinning direction. If not accounted for, the momentary pressure rise occurring upon this motor rotation in the spinning direction could either 1) damage the hydraulic motor 146, the check valve 188 or the second conduit 180, or 2) decelerate the main shaft 30 and gear train 64 so rapidly that these components are damaged. These potential drawbacks are eliminated by the inclusion of the pressure relief valve 190 which permits hydraulic fluid to bypass the check valve 188 when the pressure in the conduit 180 exceeds a preset threshold pressure. Preferably, this threshold pressure can be adjusted by adjustment of the relief valve 190. The pressure relief valve 190 therefore eliminates the need for a shear bolt which is current industry practice in mechanical-based systems.

4. Operation of Anti-Spin Mechanism

In operation, the main drive gear or bull gear 36 is driven by the sheave 42, countershaft 40, and gear 38 to rotate clockwise at a designated speed, typically about 350 rpm. When stones are fed into the crusher 10 to initiate a crushing operation, contact between the stones and the clockwise-revolving crushing head 18 imparts a counterclockwise torque to the crushing head 18 and main shaft 30. Counterclockwise rotation of the main shaft 30 results in a corresponding counterclockwise rotation of the hydraulic motor 146 at a speed increase ratio of 5:1 to 50:1. This rotation occurs without any substantial hydraulic damping due to the fact that pressurized hydraulic fluid merely flows from the first pump orifice 182, through the check valve 188, and into the second pump orifice 184 in a continuous loop as seen in FIG. 8.

When crushing ceases, the crushing head 18 will slow and stop and then tend to spin or rotate clockwise. As soon as this rotation commences, corresponding clockwise rotation of the hydraulic motor 146 quickly compresses hydraulic fluid in the second conduit 180 of the brake subcircuit 152 and increases the pressure at the second pump orifice 184 of the hydraulic motor 146 to a level that imparts resistance to the hydraulic motor 146 to arrest the motor 146 from rotation and hence to prevent the main shaft 30 from spinning. If a piece of tramp becomes lodged between the crushing head 18 and the concave surface 58 during crushing, the crushing head 18 will be forced to rotate clockwise until the tramp release cylinder 60 can open the crusher 10 to permit the tramp to fall out of the crushing chamber. This rotation is permitted by the pressure relief valve 190 which allows pressurized fluid to bypass the check valve 188 when the hydraulic pressure in the conduit 180 exceeds the safety threshold set by the relief valve 190.

The inventive anti-spin mechanism 28 exhibits many advantages over previously known anti-spin mechanisms.

For instance, it reacts immediately to a tendency of the main shaft 30 to spin and hence prevents the main shaft 30 from spinning rather than braking a rotating main shaft. Inertial loads on the hydraulic brake 62 and the main shaft 30 are therefore reduced. In fact, test data indicates that only about 180–200 psi of hydraulic pressure is generated during braking. This pressure correlates to about 3,000 inch pounds of holding force and is drastically lower than had been anticipated prior to testing. However, by permitting main shaft rotation in the spinning direction under some circumstances such as tramp relief, the anti-spin mechanism 28 reduces manganese wear, reduces shock loads on the crusher 10, and prevents stones from being thrown from the crusher.

In addition, the anti-spin mechanism 28 is usable with a solid or nearly solid one-piece main shaft 30 because it cooperates only with the lower portion of the main shaft 30. It is also easily accessible for repair or replacement because it is located beneath all major components of the crusher 10. This accessibility facilitates both new and retrofit installation and also facilitates replacement. Moreover, because it is relatively compact and can be used with a main shaft of standard length, the anti-spin mechanism does not unnecessarily increase the overall height of the crusher 10.

Other advantages of the invention, as well as many changes and modifications which could be made thereto without departing from the spirit thereof, will become apparent from the appended claims.

We claim:

1. A gyratory crusher comprising:

(A) a stationary frame;

(B) a main drive gear which is mounted on said frame and which is driven to rotate about a vertical axis;

(C) a main shaft which is rotatably supported on said main drive gear at a location which is offset from said vertical axis so as to rotate eccentrically with respect to said vertical axis, wherein said main shaft rotates in a crushing direction during a crushing operation;

(D) a crushing head mounted on said main shaft; and (E) an anti-spin mechanism comprising a hydraulic brake, said hydraulic brake including (1) a source of pressurized hydraulic fluid, and (2) a hydraulic motor which is rotationally coupled to said main shaft and which imparts a substantial resistance to main shaft rotation in a spinning direction which is opposite to said crushing direction, said hydraulic motor being supercharged by said source of pressurized hydraulic fluid so as to react essentially immediately to a tendency of said main shaft to rotate in said spinning direction.

2. A crusher as defined in claim 1, wherein said anti-spin mechanism further comprises a gear train operatively coupled to a lower portion of said main shaft and to said hydraulic brake.

3. A crusher as defined in claim 2, wherein said gear train comprises a sliding coupling to which said main shaft is slidably coupled and which rotates with said main shaft, and a gear reducer which rotationally couples said sliding coupling to said hydraulic motor so that said hydraulic motor is driven by said sliding coupling to rotate at a higher speed than said main shaft.

4. A crusher as defined in claim 3, wherein said gear reducer effects a speed increase of at least 5:1 with respect to the rotational speed of said main gear.

5. A crusher as defined in claim 4, wherein said gear reducer effects a speed increase of at least 20:1.

6. A crusher as defined in claim 5, wherein said gear reducer effects a speed increase of about 50:1.

7. A crusher as defined in claim 3, wherein said gear reducer comprises a differential planetary gear set having 1) a sun gear to which said hydraulic motor is non-rotatably coupled and 2) planet gears to which said sliding coupling is non-rotatably coupled.

8. A crusher as defined in claim 2, wherein said sliding coupling comprises a follower gear having upper and lower surfaces, a tang which is fixed to said main shaft and which is coupled to said upper surface of said follower gear so as to be fixed from rotation with respect to said follower gear but so as to be slidable in an X direction with respect to said follower gear, and a driven gear which is fixed from rotation with respect to an input element of said hydraulic motor, said lower surface of said follower gear being coupled to an upper surface of said driven gear so as to be fixed from rotation with respect to said driven gear but so as to be slidable in a Y direction with respect to said driven gear, said Y direction being perpendicular to said X direction.

9. A crusher as defined in claim 8, wherein said follower gear is coupled to said tang and to said driven gear by respective sliding tongue-and-groove connections.

10. A crusher as defined in claim 8, further comprising oil supply bores formed in said tang and said follower gear to permit the supply of lubricating oil to relatively-sliding surfaces of said tang, said follower gear, and said driven gear.

11. A crusher as defined in claim 1, further comprising a hydraulic circuit in which is disposed said hydraulic motor and said source of pressurized hydraulic fluid, said hydraulic circuit imposing minimal damping to rotation of said hydraulic motor when said main shaft rotates in said crushing direction but imposing a substantial damping to rotation of said hydraulic motor when said main shaft tends to rotate in said spinning direction.

12. A crusher as defined in claim 11, wherein said hydraulic circuit further comprises a pressure reducer disposed between said pressure source and said hydraulic motor.

13. A crusher as defined in claim 11, wherein said hydraulic circuit further comprises 1) a conduit into which hydraulic fluid is forced from said hydraulic motor when said main shaft rotates in said spinning direction, and 2) a check valve which is disposed in said conduit and which prevents fluid flow therethrough from said hydraulic motor.

14. A crusher as defined in claim 13, wherein said hydraulic circuit further comprises a relief valve which is disposed in parallel with said check valve and which permits limited fluid flow around said check valve from said hydraulic motor.

15. A crusher as defined in claim 14, wherein said relief valve is adjustable to permit a threshold pressure to be set below which fluid will not flow through said relief valve.

16. A gyratory crusher comprising:

(A) a stationary frame;

(B) a main drive gear which is mounted on said frame and which is driven to rotate about a vertical axis;

(C) a main shaft which is rotatably supported on said main drive gear at a location which is offset from said vertical axis so as to rotate eccentrically with a central axis of rotation of said main drive gear, said main shaft having an upper portion and having a lower portion, wherein said main shaft rotates in a crushing direction during a crushing operation;

(D) a crushing head mounted on said upper portion of said main shaft; and (E) an anti-spin mechanism comprising (1) a hydraulic brake located in the vicinity of said lower portion of said main shaft and operable to impose substantial resistance to main shaft rotation in a spinning direction which is opposite said crushing direction, and (2) a gear train which drivingly meshes with a mating member on said lower portion of said main shaft and which is operatively coupled to said hydraulic brake.

17. A crusher as defined in claim 16, wherein said hydraulic brake comprises a hydraulic motor which is driven by said main gear.

18. A crusher as defined in claim 17, further comprising a hydraulic circuit in which said hydraulic motor is disposed, said hydraulic circuit comprising 1) a conduit into which hydraulic fluid is forced from said hydraulic motor when said main shaft rotates in said spinning direction, and 2) a check valve which is disposed in said conduit and which prevents fluid flow therethrough from said hydraulic motor.

19. A crusher as defined in claim 18, wherein said hydraulic circuit further comprises a pressure relief valve which is disposed in parallel with said check valve and which permits limited fluid flow around said check valve from said hydraulic motor.

20. A gyratory crusher comprising:

(A) a stationary frame;

(B) a main drive gear which is mounted on said frame and which is driven to rotate about a vertical axis;

(C) a main shaft which is rotatably supported on said main drive gear at a location which is offset from said vertical axis so as to rotate eccentrically with a central axis of rotation of said main drive gear, said main shaft having an upper portion and having a lower portion, wherein said main shaft rotates in a crushing direction during a crushing operation;

(D) a crushing head mounted on said upper portion of said main shaft; and (E) an anti-spin mechanism comprising (1) a hydraulic brake located in the vicinity of said lower portion of said main shaft and operable to impose substantial resistance to main shaft rotation in a spinning direction which is opposite said crushing direction, and (2) a gear train operatively coupled to said lower portion of said main shaft and to said hydraulic brake, wherein said gear train comprises (a) a sliding coupling on which said main shaft is slidably coupled and which rotates with said main shaft; and (b) a gear reducer which rotationally couples said sliding coupling to said hydraulic motor so that said hydraulic motor is driven by said sliding coupling to rotate at a higher speed than said main shaft.

21. A crusher as defined in claim 20, wherein said gear reducer effects a speed increase of at least 5:1 with respect to the rotational speed of said main shaft.

22. A crusher as defined in claim 21, wherein said gear reducer comprises a planetary gear assembly having 1) a sun gear to which said hydraulic brake is non-rotatably coupled and 2) planet gears to which said sliding coupling is non-rotatably coupled.

23. A crusher as defined in claim 20, wherein said sliding coupling comprises a follower gear having upper and lower surfaces, a tang which is fixed to said main shaft and which is coupled to said upper surface of said follower gear so as to be fixed from rotation with respect to said follower gear but so as to be slidable in an X direction with respect to said follower gear, and a driven gear which is fixed from rotation with respect to an input element of said hydraulic brake, said lower surface of said follower gear being coupled to an upper surface of said driven gear so as to be fixed from rotation with respect to said driven gear but so as to be slidable in a Y direction with respect to said driven gear, said Y direction being perpendicular to said X direction.

24. A crusher as defined in claim 23, further comprising oil supply bores formed in said tang and said follower gear to permit the supply of lubricating oil to relatively-sliding surfaces of said tang, said follower gear, and said driven gear.

25. A gyratory crusher comprising:

(A) a stationary frame;

(B) a main drive gear which is mounted on said frame and which is driven to rotate about a vertical axis;

(C) a main shaft which is rotatably supported on said main drive gear at a location which is offset from said vertical axis so as to rotate eccentrically with respect to said vertical axis, wherein said main shaft has upper and lower portions, and wherein said main drive shaft rotates in a crushing direction during a crushing operation;

(D) a crushing head mounted on said upper portion of said main shaft; and (E) an anti-spin mechanism comprising a hydraulic brake, said hydraulic brake including (1) a gear train including (a) a sliding coupling to which said main shaft is slidably coupled and which rotates with said main shaft, said sliding coupling including (i) a follower gear having upper and lower surfaces, (ii) a tang which is fixed to said lower portion of said main shaft and which is coupled to said upper surface of said follower gear by a first tongue and groove connection so as to be fixed from rotation with respect to said follower gear but so as to be slidable in an X direction with respect to said follower gear, and (iii) a driven gear which is coupled to said lower surface of said follower gear by a second tongue and groove connection so as to be fixed from rotation with respect to said driven gear but so as to be slidable in a Y direction with respect to said driven gear, said Y direction being perpendicular to said X direction, wherein oil supply bores are formed in said tang and said follower gear to permit the supply of lubricating oil to relatively-sliding surfaces of said tang, said follower gear, and said driven gear, and (b) a gear reducer which rotationally couples said driven gear to said hydraulic motor so that said hydraulic motor is driven by said sliding coupling to rotate at a higher speed than said sliding coupling, said gear reducer comprising a differential planetary gear set having i) planet gears to which said driven gear is non-rotatably coupled, and ii) a sun gear, (2) a hydraulic motor which is non-rotatably coupled to said sun gear and which imparts a substantial resistance to main shaft rotation in a spinning direction which is opposite to said crushing direction, and (3) a hydraulic circuit including, (a) a source of pressurized hydraulic fluid which supercharges said hydraulic motor so that said hydraulic motor reacts essentially immediately to a tendency of said main shaft to rotate in said spinning direction to damp rotation of said main shaft in said spinning direction, (b) a conduit into which hydraulic fluid is forced from said hydraulic motor when said main shaft rotates in said spinning direction, (c) a check valve which is disposed in said conduit and which prevents fluid flow therethrough from said hydraulic motor, and (d) a relief valve which is disposed in parallel with said check valve and which permits limited fluid flow around said check valve from said hydraulic motor.

26. A method comprising:

(A) providing a gyratory crusher including a stationary frame, a main drive gear rotatably mounted on said frame, and a main shaft which is mounted on said main drive gear so as to be rotatable about an axis which is offset from a central axis of said drive gear;

(B) driving said main drive gear to rotate;

(C) permitting said main shaft to rotate about its axis in a crushing direction during a crushing operation in which rock is being crushed by said crusher; and (D) selectively braking said main shaft by imparting a substantial resistance to main shaft rotation in a spinning direction which is opposite to said crushing direction, the resistance being imposed by a hydraulic motor which is supercharged by a source of pressurized hydraulic fluid so as to react essentially immediately to a tendency of said main shaft to rotate in said spinning direction.

27. A method as defined in claim 26, wherein said hydraulic motor is coupled to said main shaft by a gear train which permits sliding movement of said main shaft relatively to said hydraulic motor while preventing relative rotational movement between said hydraulic motor and said main shaft.

28. A method as defined in claim 27, wherein said gear train couples said hydraulic motor to said main shaft so that said hydraulic motor rotates at a higher rotational speed than said main shaft.

29. A method as defined in claim 28, wherein said hydraulic motor rotates at about fifty times the rotational speed of said main shaft.

30. A method as defined in claim 26, further comprising reducing the pressure of hydraulic fluid flowing from said source of pressurized hydraulic fluid to said hydraulic motor.

31. A method as defined in claim 26, wherein the braking step comprises 1) forcing hydraulic fluid into a conduit from said hydraulic motor when said main shaft rotates in said spinning direction, and 2) preventing fluid flow through said conduit via operation of a check valve which is disposed in said conduit.

32. A method as defined in claim 31, further comprising permitting limited hydraulic fluid flow around said check valve when hydraulic pressure in said conduit exceeds a threshold value.

33. A method as defined in claim 32, wherein said threshold value is adjustable.

* * * * *

UNITED STATES PATENT AND TRADEMARK OFFICE

CERTIFICATE OF CORRECTION

PATENT NO. : 5,931,394
DATED : August 3, 1999
INVENTORS : Matthew B. HAVEN et al.

It is certified that error appears in the above-identified patent and that said Letters Patent is hereby corrected as shown below:

On the title page, item [56]:

"*Attorney, Agent or Firm*—Willes & Willes, S.C." should read:

-- ***Attorney, Agent or Firm*—Nilles & Nilles, S.C.** --

Signed and Sealed this

Thirtieth Day of November, 1999

*Attest:*

*Attesting Officer*

Q. TODD DICKINSON

*Acting Commissioner of Patents and Trademarks*